United States Patent [19]

Titmas

[11] Patent Number: 4,874,560

[45] Date of Patent: Oct. 17, 1989

[54] APPARATUS FOR EFFECTING SELECTED PATTERNS OF FLUID FLOW

[75] Inventor: James A. Titmas, Dallas, Tex.

[73] Assignee: Oxidyne Corporation, Dallas, Tex.

[21] Appl. No.: 373,685

[22] Filed: Jun. 30, 1989

Related U.S. Application Data

[63] Continuation of Ser. No. 204,130, Jun. 6, 1988, abandoned.

[51] Int. Cl.[4] ..... B01F 3/04

[52] U.S. Cl. ..... 261/76; 239/431; 239/427.3; 261/123; 210/747; 366/338; 366/340

[58] Field of Search ..... 239/431, 434, 427.3; 261/123, 76; 210/747; 366/338, 340

[56] References Cited

U.S. PATENT DOCUMENTS

| | | | |
|---|---|---|---|
| 795,044 | 7/1905 | Kraus | 239/427.3 |
| 867,382 | 10/1907 | Krieg | 239/427.3 |
| 1,427,202 | 8/1922 | Fumess et al. | 239/431 |
| 1,441,982 | 1/1923 | Heylman et al. | 239/434 |
| 1,945,489 | 1/1934 | Manley | 261/123 |
| 3,421,699 | 1/1969 | Babington et al. | 239/434 |
| 3,874,643 | 4/1975 | Loreniam et al. | 366/338 |
| 3,984,504 | 10/1976 | Pick | 261/76 |
| 4,522,504 | 6/1985 | Greverath | 366/338 |
| 4,625,916 | 12/1986 | Nieuwkamp et al. | 239/431 |
| 4,744,908 | 5/1988 | Peterschek et al. | 210/747 |

FOREIGN PATENT DOCUMENTS

| | | | |
|---|---|---|---|
| 36850 | 10/1935 | Netherlands | 261/123 |
| 1251124 | 10/1971 | United Kingdom | 366/338 |

*Primary Examiner*—Tim Miles

*Attorney, Agent, or Firm*—Kanz, Scherback & Timmons

[57] ABSTRACT

Disclosed are methods and apparatus for effecting a selected pattern of fluid flow wherein a first fluid is caused to flow along the surface of a body and a second fluid is caused to flow out of a plurality of holes in the surface of the body. The holes are arranged in a pattern so that the flow of the second fluid creates a baffle to change the direction of flow of the first fluid. The pattern is a grouping of holes wherein the grouping may be a straight line or a helix around a tubular body. The holes are rectangular in cross-section to form a fan-shaped pattern in the fluid passing through the holes. The longitudinal axis of each hole does not intersect the center of adjacent holes.

16 Claims, 4 Drawing Sheets

APPARATUS FOR EFFECTING SELECTED PATTERNS OF FLUID FLOW

This is a continuation of application Ser. No. 07/204,130, filed June 6, 1988, now abandoned.

This invention relates in general to the field of fluid dynamics. More particularly, it relates to methods and apparatus for using the flow of one fluid to cause a change in the direction of flow of a second fluid.

The direction of flow of a fluid can be changed by applying a force to the fluid. One method of applying a force to the fluid is by placing a solid object, such as a barrier, vane, propeller, wing or other deflector within the fluid path.

The direction changing force may also be applied by a fluid flowing in a different direction. The two fluids may be the same or different fluids. For example, U.S. Pat. No. 4,533,123 issued Aug. 6, 1985 to O'Leary illustrates a device in which the direction of flow of a fluid is changed by the same fluid flowing in a different direction. The fluid is first caused to flow through the annulus between two tubular pipes. The same fluid is also caused to flow out of the inner pipe through holes in the sides of the inner pipe. The flow of the fluid through the holes causes fluid flowing through the annulus to swirl. The resulting turbulence expedites mixing of the fluid.

U.S. Pat. No. 2,094,664 issued Oct. 5, 1937 to Monahan shows a device in which different fluids ar used. Water flows through the annulus between two tubular members. Steam flows out of a plurality of holes in the inner pipe. The steam is thus mixed with the water to heat the water.

One practical application of a method of mixing two fluids is the treatment of waste water by wet oxidation. In wet oxidation, oxygen is mixed with waste water under conditions which cause oxidation of combustibles in the water. U.S. Pat. No. 3,449,247 issued June 10, 1969 to Bauer shows a method and apparatus for performing wet oxidation of waste water. The Bauer method and apparatus involve a plurality of concentric pipes extending into a cased hole in the earth. The increased temperatures and pressures found downhole expedite the chemical reaction between oxygen and the waste water combustibles.

The present invention provides methods and apparatus for effecting selected patterns of fluid flow. The apparatus includes a pair of concentric tubular pipes forming an annulus between the two pipes. A first fluid, such as a liquid, flows through the annulus between the two pipes. A second fluid, such as a gas, flows through the inner pipe and out through a plurality of holes in the sides of the inner pipe. The holes are arranged in a pattern, such as a helix, so that the flow of the second fluid creates a baffle to change the direction of flow of the first fluid. In one embodiment the holes in the first pipe are rectangular and the extended longitudinal axes of the hole are canted with respect to each other so as not to intersect adjacent holes. This causes a fan-shaped flow of fluid flowing from each hole to overlap the fans from adjacent holes, thus forming a larger and more complete baffle.

The methods and apparatus of the invention are particularly useful in treating waste water by wet oxidation. Waste water is pumped through the annulus between a pair of concentric tubular pipes. Oxygen is pumped down through the inner pipe and out into the annulus through a plurality of holes in the inner pipe.

The flow of oxygen out of the holes creates a baffle to change the direction of flow of the waste water. Thus the injected oxygen is used to cause turbulent mixing of the fluids under conditions which would be deleterious to mechanical mixing devices. Furthermore, since the mixing is performed by gas vanes, there are no solid vanes which are subject to deposits and other conditions which could restrict flow. Other features and advantages of the invention will become more readily understood from the following detailed description taken in connection with the appended claims and attached drawing in which:

Figure 1:
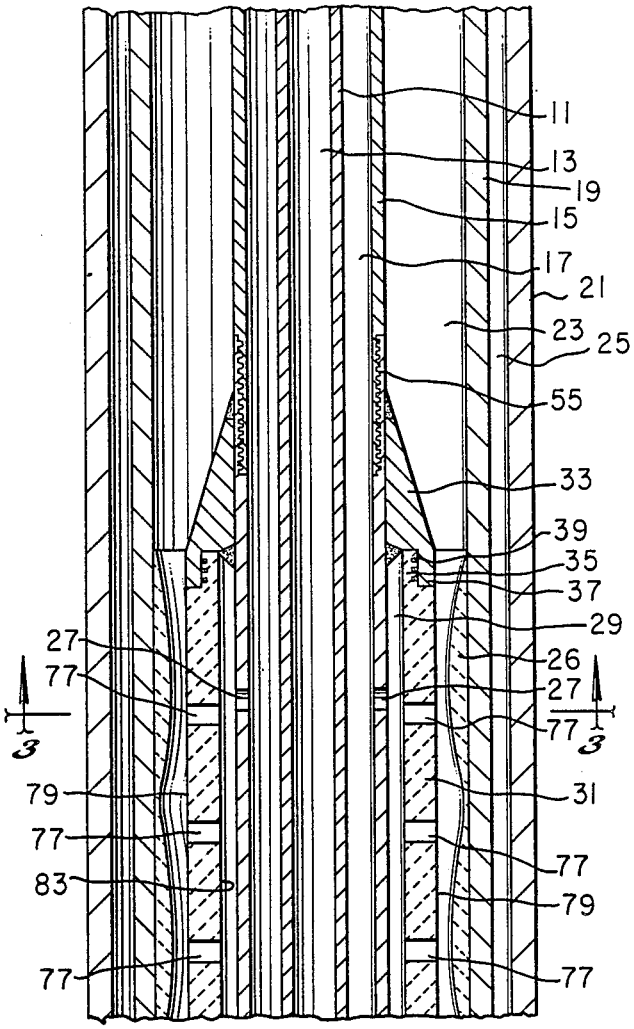
FIG. 1 is a longitudinal sectional view of the upper portion of apparatus employing the preferred embodiment of the invention.

One practical application of the method and apparatus of the invention is in the field of waste water treatment by wet oxidation. A borehole is drilled into the earth and the waste water is pumped into a U-shaped tube placed in the hole. Near the bottom of the hole, the high pressures and temperatures encountered facilitate chemical reactions. Oxygen is mixed with the waste water at the elevated temperatures and pressures to oxidize combustible materials in the waste water. Even if the waste water is saturated with oxygen, only a very small portion of the combustible materials can be oxidized. Therefore, it is necessary to continuously replenish the oxygen in the waste water as the waste water flows through the apparatus at high pressures and temperatures.

As shown in FIGS. 1–4 the preferred embodiment of the apparatus of the invention includes four concentric tubular members. The innermost tubular member 11 is a steam line. The steam line 11 has a bore 13 which conveys steam to the bottom of the reactor to preheat the apparatus of the invention.

An oxygen delivery tube 15 surrounds the steam line 11 forming an annulus 17. The two remaining tubular members are an inner tubular member 19 and an outer tubular member 21. The oxygen delivery tube 15, the inner tubular member 19 and the outer tubular member 21 form an inner annulus 23 and an outer annulus 25. The outer tubular member 21 is closed at its lower end and the inner tubular 19 is open at its lower end. Therefore, the inner annulus 23 and the outer annulus 45 are in fluid communication so fluid flowing through one annulus is returned in the opposite direction through the other annulus. Waste water (or some other process fluid) can be pumped downward through the inner annulus 23 and returned upward through the outer annulus 25. Alternatively, the process fluid can be pumped downward through the outer annulus 25 and returned up the inner annulus 23.

A ceramic inner liner 26 is bonded to the inner surface of the inner tubular member 19. The inner liner 26 has a variable thickness and thus varies the cross-sectional area of the annulus 23 and to create a plurality of annulus venturi zones. As the process fluid flows through these venturi zones the velocity and pressure of the fluid varies. The ceramic inner liner 26 also protects the inner surface of the inner tubular member 19 from erosion.

Oxygen is pumped down through the annulus 17 between the steam line 11 and the oxygen delivery tube 15. The oxygen delivery tube 15 has a plurality of holes 27 through which the oxygen may pass out of the annulus 17 and into an annular chamber 29 formed between the oxygen delivery tube 15 and a series of ceramic tubular sections 31. Each ceramic tubular section 31 is about eight to ten feet long and there will normally be about four sections 31 in the series.

The upper end of the ceramic tubular sections 31 is restrained by a top ring block 33. The top ring block 33 is generally conical in shape and is welded to the outer surface of the oxygen delivery tubular 15. The conical top ring block 33 decreases the cross-sectional area of the inner annulus 23, causing a venturi effect on the process fluid flowing through the inner annulus 23.

The uppermost ceramic tubular section 31 has an upwardly extending lip 35 which fits within a downwardly extending lip 37 on the top ring block 33. A plurality of castellated rings 39 on the lip 35 of the ceramic tubular section 31 mate with a prepared surface on the lip 37 of the top ring block 33 to resist the escape of the oxygen confined in the annular chamber 29.

The lowermost ceramic tubular section 31 has a downwardly extending lip 41 which engages a movable ring block 43. A plurality of castellated rings 45 on the lip 41 of the ceramic tubular section 31 mate with a prepared surface on the movable ring block 43 to resist the escape of the oxygen confined in the annular chamber 29. A plurality of 0-rings 47 form a seal between the inner surface of the movable ring block 43 in the outer surface of the oxygen delivery tube 15.

The movable ring block 43 is biased in an upward direction by a spring 49. The spring 49 is compressed between the movable ring block 43 and a lower ring block 51. The lower ring block 51 is generally conical in shape and is welded to the outer surface of the oxygen delivery tube 15. The conical lower ring block 51 decreases the cross-sectional area of the inner annulus 23, causing a venturi effect on the process fluid flowing through the inner annulus 23.

A spring cover 53 extends downward from the movable ring block 43 and covers the spring 49. The spring cover 53 slideably engages the lower ring block 51 and protects the spring 49 from materials which may precipitate in the annulus 23. Without such protection, precipitates on the spring 49 will interfere with the proper functioning thereof.

The oxygen delivery tube 15 has a threaded connection 55 near the top ring block 33 and a threaded connection 57 near the lower ring block 51. Therefore, a plurality of the assemblies shown in FIGS. 1 and 2 can be threaded together in series. At the bottom of the last of these assemblies (shown in FIG. 4) an elongated coupling 59 is connected to the oxygen delivery tube 15 at the threaded connection 61. Three or more lugs 63 guide and center the steam line 11 through a movable ring block seal 65. The ring block seal 65 has castellated flow resistors 67 which mate with a machined portion of the outer surface of the steam line 11.

The ring block seal 65 is held against a stop ring 69 located on the bottom of the lugs 63 by a compression spring 71. The spring 71 is compressed between the movable ring block seal 65 in a jamb ring block 73. The jamb ring block 73 is threaded into the lower end of the elongated coupling 59.

When the movable ring block seal 65 is held against the stop ring 69, the ring block seal 65 covers a plurality of holes 75 in the elongated coupling 59. If the pressure of the oxygen within the annulus 17 overcomes the compressive strength of the spring 71, the ring block seal 65 will be forced downward. Downward motion of the ring block seal 65 uncovers the holes 75 and bleeds off any excess pressure within the annulus 17.

Figure 3:
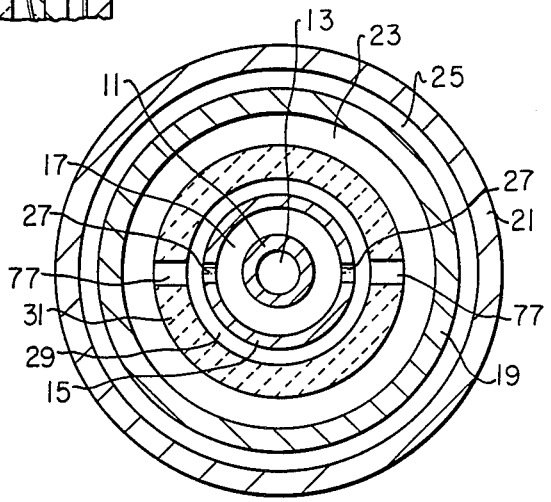
FIG. 3 is a transverse sectional view taken along line 3—3 in FIG. 1.
Figure 2:
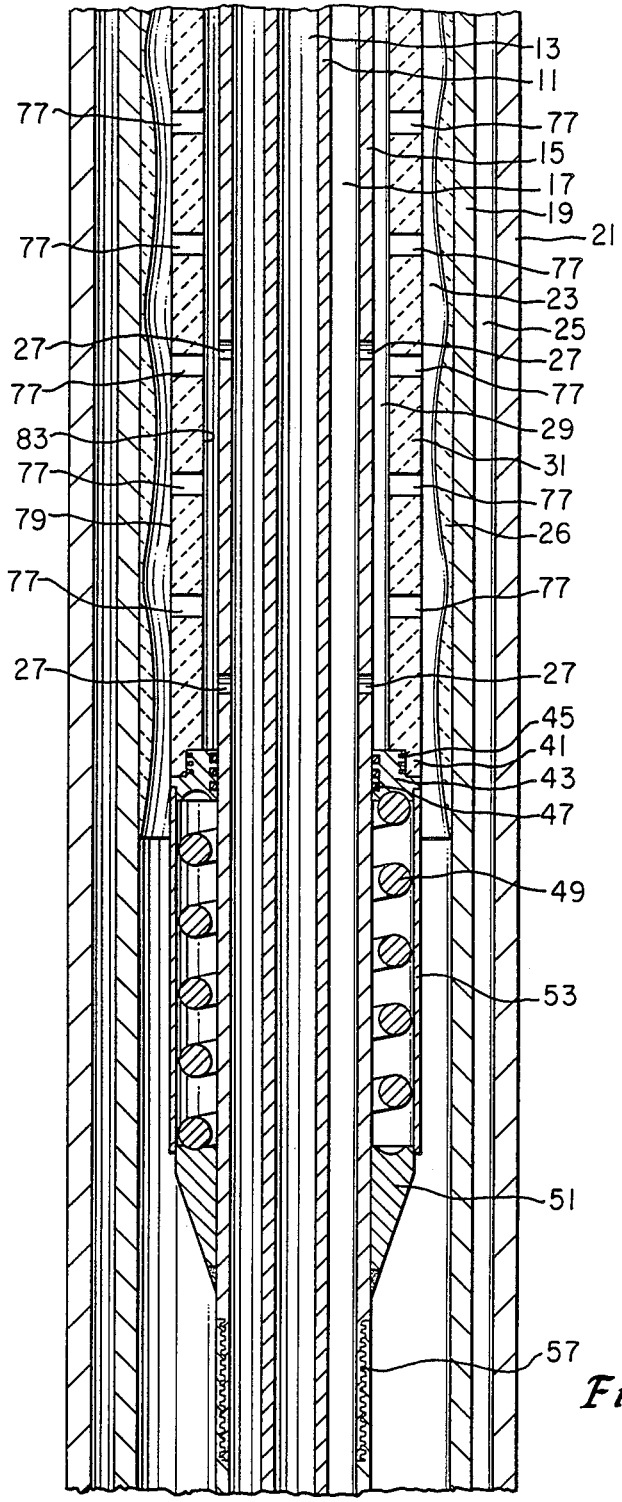
FIG. 2 is a longitudinal sectional view of the middle portion of the apparatus of FIG. 1.
Figure 4:
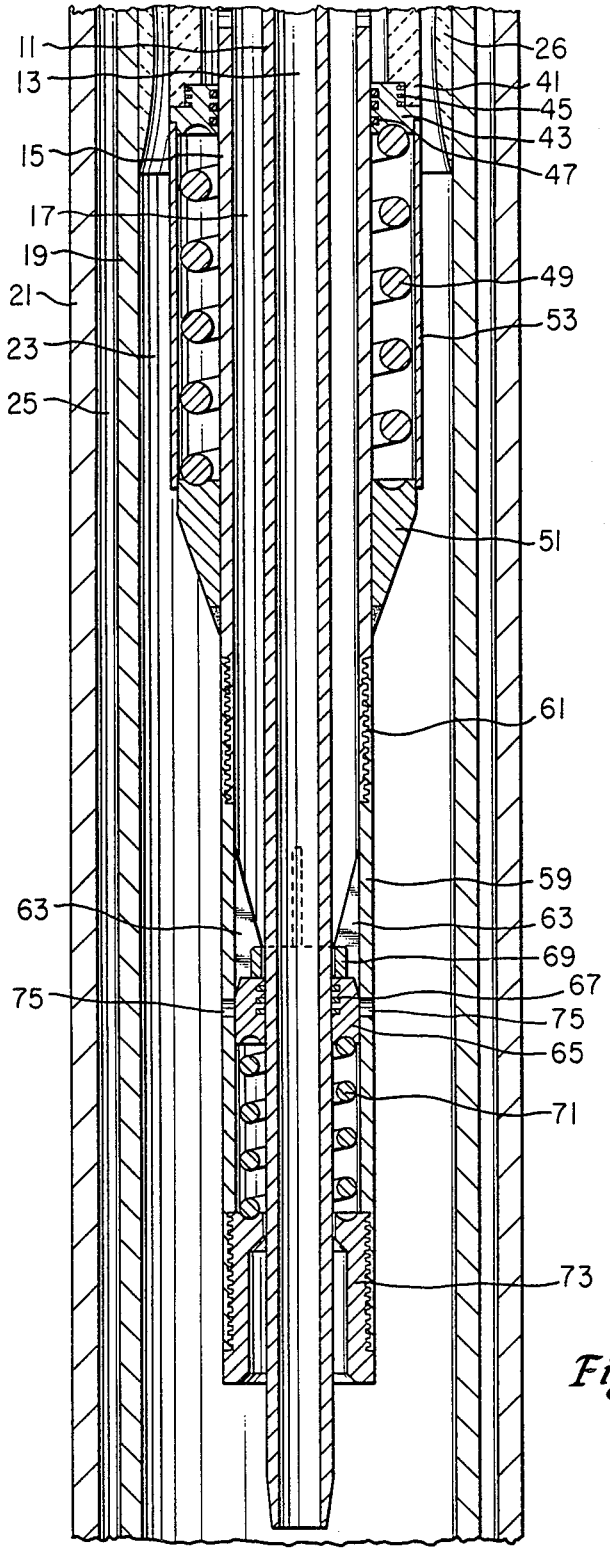
FIG. 4 is a longitudinal sectional view of the lower end of the apparatus of FIG. 1.

As shown in FIGS. 1–3, the ceramic tubular sections 31 each have a plurality of holes 77 which allow fluid from the annular chamber 29 to flow into the inner annulus 23. As oxygen is pumped down the oxygen delivery tube 15 and through the holes 27 in the oxygen delivery tube 15 into the annular chamber 29, the pressure in the annular chamber 29 increases. When the pressure within the chamber 29 exceeds the pressure in the inner annulus 23, the oxygen flows through the holes 77 into the inner annulus 23. Differences in pressure between the top and bottom of the apparatus can be compensated for, if desired, by providing more or larger holes 77 at the bottom.

As the waste water or other fluid flows through the inner annulus 23, the process fluid flows along the surface 79 of the ceramic tubular sections 31. The oxygen or other fluid from the annular chamber 29 flows through the holes 77 into the process fluid as it flows across the surface 79 of the ceramic tubular sections 31. The ceramic tubular sections 31, being ceramic, are porous and allow micro-bubbles of oxygen to migrate through the ceramic sections 31.

Figure 5:
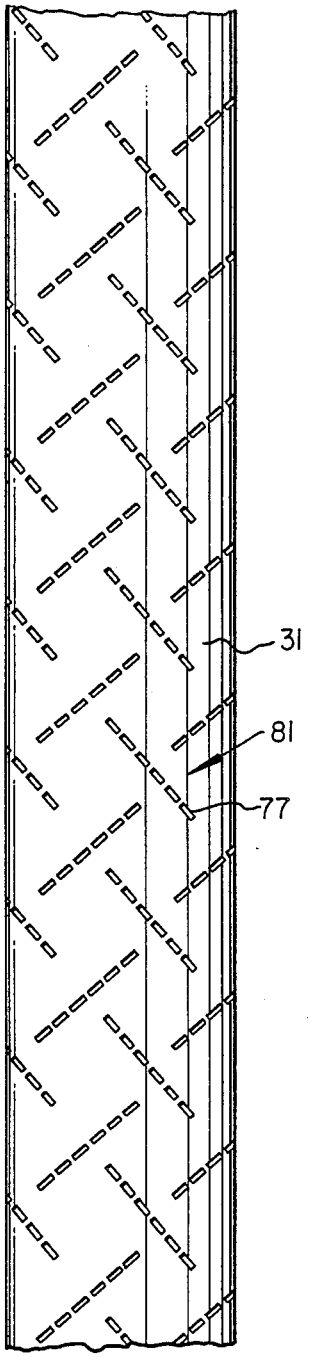
FIG. 5 is a side view of the inner tubular section of the apparatus of FIG. 1 showing helical patterns of groupings of holes.
Figure 6:
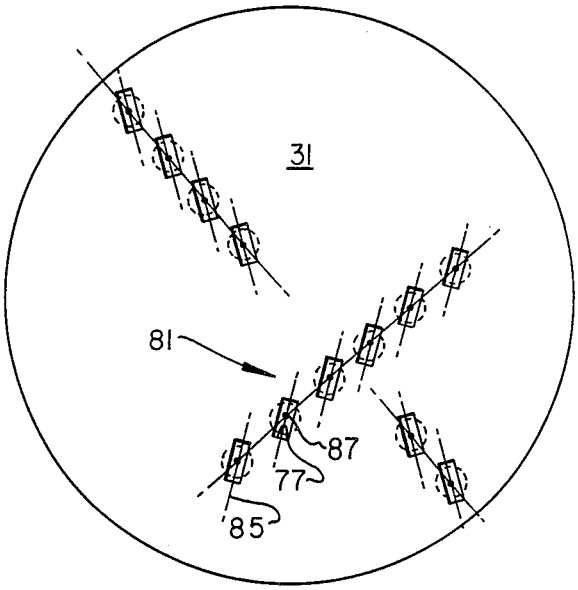
FIG. 6 is a close-up view of the holes illustrated in FIG. 5.

FIGS. 5 and 6 show the preferred arrangement of the holes 77 in the ceramic tubular sections 31. Preferably, the holes 77 are arranged in groupings 81 of six holes each. Each grouping 81 of holes 77 would be arranged in a straight line if the ceramic tubular sections 31 were flat. Since the ceramic tubular sections 31 are tubular, the straight lines of the groupings 81 become helical. Each helical grouping 81 of holes 77 is perpendicular to the next successive grouping 81 as shown in FIGS. 5 and 6. The oxygen flowing out of each grouping 81 of holes 77 creates a baffle to change the direction of flow of the process fluid across the surface 79 of the ceramic sections 31. The perpendicular arrangement of the groupings 81 results in voids in the pattern, to cause the process fluid to be tumbled back and forth and in and out as the process fluid flows through the inner annulus 23.

Figure 7:
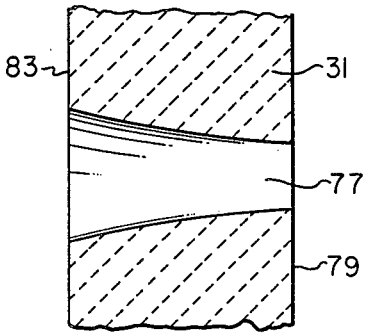
FIG. 7 is a sectional view of one of the holes illustrated in FIG. 6.

FIGS. 6 and 7 illustrate the preferred shape of the holes 77. Each hole 77 passes from the inner surface 83 of the ceramic tubular section 31 to the outer surface 79. At the inner surface 83 the hole is circular. As the hole passes through the ceramic section 31 the hole gradually becomes rectangular. At the outer surface 79 the holes 77 are rectangular as shown in FIGS. 5 and 6. This particular shape of the holes 77 causes a fan-like discharge of the oxygen as the oxygen exits from the holes 77.

Each of the rectangular holes 77 has a longitudinal axis 85 as shown in FIG. 6. Each rectangular opening of the holes 77 in any one grouping 81 is canted with respect to other holes so that the extended longitudinal axis 85 of each hole does not pass through the center 87 of the adjacent holes 77. This particular orientation of the holes 77 within the grouping 81 creates a larger and more powerful baffle.

The method and apparatus of the invention have several advantages over the prior art. The invention utilizes the injection of one fluid into the flow of a second fluid to change the direction of flow of the second fluid. Thus, a baffle can be created within the second fluid which can be easily removed by stopping the flow of the first fluid. As in the case of wet oxidation, the method and apparatus of the invention create an improved mixing of the first fluid into the second fluid. In particular, the method and apparatus of the invention create an improved mixing of oxygen into a process fluid to facilitate oxidation of the process fluid. The changes in velocity and pressure in the process fluid flow caused by the venturi effects of the inner liner 26, the top ring block 33 and the lower ring block 51 improve the mixing of the oxygen into the process fluid.

Only the preferred embodiment of the invention has been shown. It should be apparent to those skilled in the art that various changes, modifications and substitutions may be made without departing from the scope of the invention as defined by the appended claims.

What is claimed:

1. Apparatus for effecting a selected pattern of fluid flow comprising a body for separating a first fluid and second fluid having a first surface along which the first fluid flows, a second surface, and a plurality of discrete groupings of holes passing through the body from the second surface to the first surface through which a second fluid flows, wherein each grouping contains a plurality of closely associated holes arranged in a substantially straight line and each grouping is substantially perpendicular to the next successive grouping.

2. Apparatus for effecting a selected pattern of fluid flow comprising:

an inner tubular pipe having a plurality of discrete groupings of holes therein, wherein each grouping contains a plurality of closely associated holes arranged in a substantially straight line and each grouping is substantially perpendicular to the next successive grouping;

an outer tubular pipe concentric with the inner pipe forming an annulus between the two pipes;

means for causing a first fluid to flow through the annulus between the two pipes; and means for causing a second fluid to flow from the inner pipe into the annulus through said holes in the inner pipe.

3. Apparatus for effecting wet oxidation comprising:

a first pipe extending downward into a borehole;

a second pipe extending downward into the borehole surrounding and substantially concentric with the first pipe forming a first annulus between the first and second pipes;

a third pipe extending downward into the borehole surrounding and substantially concentric with the first and second pipe forming a second annulus between the second and third pipes;

means for pumping process fluid down one annulus and back up the other annulus; and means for pumping oxygen down through the first pipe, wherein the first pipe has a plurality of discrete groupings of holes, wherein each grouping contains a plurality of closely associated holes arranged in a helix and each grouping is substantially perpendicular to the next successive grouping, such that the flow of oxygen through the holes creates a baffle for changing the direction of flow of the process fluid.

4. Apparatus for effecting a selected pattern of fluid flow comprising:

a body for separating two fluids and having a first surface, a second surface and holes passing from said second surface to said first surface;

means for causing a first fluid to flow along said first surface of the body; and means for causing a second fluid to flow through said holes from said second surface to said first surface, wherein the holes are arranged in a pattern so that the flow of the second fluid therefrom creates a baffle to change the direction of flow of the first fluid;

wherein the outlet end of each hole is rectangular in cross-section and the extended longitudinal axis of each rectangular hole is canted so as not to intersect the adjacent holes and so that the fan-shaped pattern formed by fluid emitted from each hole overlaps the fan-shaped patterns from adjacent holes.

5. Apparatus for effecting a selected pattern of fluid flow comprising:

an inner tubular pipe having a plurality of holes therein;

an outer tubular pipe concentric with the inner pipe forming an annulus between the two pipes;

means for causing a first fluid to flow through the annulus between the two pipes; and means for causing a second fluid to flow from the inner pipe into the annulus through said holes in the inner pipe, wherein the holes are arranged in a pattern including a plurality of groupings of holes with each grouping comprising a plurality of holes arranged in a helix so that the flow of the second fluid creates a baffle to change the direction of flow of the first fluid;

wherein each hole in the inner pipe is rectangular in the cross-section at the outer surface of the pipe to create a fan-shaped pattern in the second fluid as it flows out of each hole and the extended longitudinal axis of each rectangular hole is canted so as not to intersect adjacent holes and so that the fan-shaped pattern formed by fluid emitted from each hole overlaps the fan-shaped pattern from adjacent holes.

6. Apparatus for effecting wet oxidation comprising:

a first pipe extending downward into a borehole;

a second pipe extending downward into the borehole surrounding and substantially concentric with the first pipe forming a first annulus between the first and second pipes;

a third pipe extending downward into the borehole surrounding and substantially concentric with the first and second pipes forming a second annulus between the second and third pipes;

means for pumping process fluid down one annulus and back up the other annulus; and means for pumping oxygen down through the first pipe, wherein the first pipe has a plurality of holes arranged in a pattern such that the flow of oxygen through the holes creates a baffle for changing the direction of flow of the process fluid;

wherein the pattern of the holes in the first pipe includes a plurality of groupings of holes and wherein each groping is a plurality of holes arranged in a helix;

wherein each hole in the first pipe is rectangular in cross-section at the outer surface of the pipe to create a fan-shaped pattern as the oxygen flows through the holes; and wherein the extended longitudinal axis of each rectangular hole is canted so as not to intersect the adjacent holes and so that the fan-shaped pattern formed by each hole overlaps the fan-shaped patterns from adjacent holes.

7. Apparatus for effecting a selected pattern of fluid flow comprising:

an inner tubular pipe having a plurality of holes therein;

an outer tubular pipe concentric with the inner pipe forming an annulus between the two pipes;

means for causing a first fluid to flow through the annulus between the two pipes;

means for causing a second fluid to flow from the inner pipe into the annulus through said holes in the inner pipe; and a liner of varying thickness located between the inner and outer pipes to vary the velocity and the pressure of the first fluid as the first fluid flows through the annulus between the two pipes.

8. Apparatus as defined in claim 7 wherein the inner liner is secured to the inner surface of the outer pipe.

9. Apparatus as defined in claim 8 wherein the inner liner is ceramic.

10. Apparatus for effecting wet oxidation comprising:

a first pipe extending downward into a borehole;

a second pipe extending downward into the borehole surrounding and substantially concentric with the first pipe forming a first annulus between the first and second pipes;

a third pipe extending downward into the borehole surrounding and substantially concentric with the first and second pipes forming a second annulus between the second and third pipes;

means for pumping process fluid down one annulus and back up the other annulus; and means for pumping oxygen down through the first pipe, wherein the first pipe has a plurality of holes arranged in a pattern such that the flow of oxygen through the holes creates a baffle for changing the direction of flow of the process fluid; and wherein the first pipe has a section in which the holes are located which is porous to allow relatively small bubbles of oxygen to pass through the walls of the first pipe as well as through the holes.

11. Apparatus as defined in claim 10 wherein the porous section of the first pipe is ceramic.

12. Apparatus as defined in claim 10 wherein the porous section of the first pipe comprises:

an inner pipe having a plurality of holes to allow the oxygen to pass through the inner pipe; and an outer pipe having the pattern of holes so that the flow of oxygen out of the holes creates a baffle to change the direction of flow of the process flow.

13. Apparatus as defined in claim 12 wherein the outer pipe is porous to allow relatively small bubbles of oxygen to pass through the walls of the outer pipe as well as through the holes in the outer pipe.

14. Apparatus as defined in claim 13 wherein the outer pipe is ceramic.

15. Apparatus as defined in claim 14 wherein the outer pipe comprises a plurality of ceramic sections.

16. Apparatus as defined in claim 15 further including means for biasing the ceramic sections to compensate for different thermal expansion rates between the inner and outer pipes.

* * * * *